US011643319B2

(12) United States Patent
Christiansen

(10) Patent No.: US 11,643,319 B2
(45) Date of Patent: May 9, 2023

(54) BEVERAGE DISPENSING SYSTEM, A BEVERAGE DISPENSING ASSEMBLY, A METHOD OF OPERATING A BEVERAGE DISPENSING SYSTEM AND A PRESSURE HOUSING

(71) Applicant: Carlsberg Breweries A/S, Copenhagen (DK)

(72) Inventor: Jonas Christiansen, Copenhagen (DK)

(73) Assignee: Carlsberg Breweries A/S, Copenhagen V (DK)

( * ) Notice: Subject to any disclaimer, the term of this patent is extended or adjusted under 35 U.S.C. 154(b) by 405 days.

(21) Appl. No.: 16/492,723

(22) PCT Filed: Mar. 2, 2018

(86) PCT No.: PCT/EP2018/055191
§ 371 (c)(1),
(2) Date: Sep. 10, 2019

(87) PCT Pub. No.: WO2018/162351
PCT Pub. Date: Sep. 13, 2018

(65) Prior Publication Data

US 2021/0139305 A1 May 13, 2021

(30) Foreign Application Priority Data

Mar. 10, 2017 (EP) ..... 17160349

(51) Int. Cl.
*B67D 1/04* (2006.01)
*B67D 1/07* (2006.01)
*B67D 1/08* (2006.01)

(52) U.S. Cl.
CPC ..... *B67D 1/0462* (2013.01); *B67D 1/07* (2013.01); *B67D 1/0865* (2013.01);
(Continued)

(58) Field of Classification Search
CPC ..... B65D 11/188; B65D 11/1886; B65D 77/065; B65D 77/068; B65D 77/067;
(Continued)

(56) References Cited

U.S. PATENT DOCUMENTS 5,471 A * 3/1848 Tough ..... F25D 3/04 62/139
1,772,111 A * 8/1930 Rice ..... B67D 1/0857 222/173

(Continued)

FOREIGN PATENT DOCUMENTS

CN 103889882 A 6/2014
EP 2154103 2/2010

(Continued)

OTHER PUBLICATIONS

Notice of Reasons for Rejection dated Nov. 9, 2021, related to JP appl. No. 2019-548932.

(Continued)

*Primary Examiner* — Timothy L Maust
(74) *Attorney, Agent, or Firm* — BakerHostetler

(57) ABSTRACT

Beverage dispensing system comprising a pressure housing comprising a first housing part 12, 12' having a connector aperture 22, and a second housing part 14, 14'. The system further comprises a pair of connectors 24, 24' connectable to the connector aperture in a pressure-tight sealing connection. The pair of connectors 24, 24' comprises a first connector 24 having a through-going hole for allowing guiding a first tapping line 20 through the through-going hole and a second connector 24' being connectable to a second tapping line. The system further comprises a pair of beverage containers 16, 16', both accommodating a carbonated beverage and having a beverage outlet. A first beverage container 16 of the pair of beverage containers comprises the first tapping line 20 communicating with the beverage (Continued)

outlet. A second beverage container 16' of the pair of beverage containers has an openable seal for establishing connection from the beverage outlet to the second connector 24'. The system further comprises a pressure inlet.

16 Claims, 7 Drawing Sheets

(52) U.S. Cl.
CPC ..... *B67D 2001/082* (2013.01); *B67D 2210/00049* (2013.01); *B67D 2210/00062* (2013.01); *B67D 2210/00131* (2013.01); *B67D 2210/00133* (2013.01)

(58) Field of Classification Search
CPC ..... B65D 5/74–746; B67D 1/045; B67D 1/0462; B67D 2001/0827; F25D 3/04; F25D 3/045
See application file for complete search history.

(56) References Cited

U.S. PATENT DOCUMENTS

| | | | | |
|---|---|---|---|---|
| 3,321,861 | A * | 5/1967 | Tate, Jr. | B67D 1/0872 362/183 |
| 4,098,434 | A * | 7/1978 | Uhlig | B65D 83/0055 222/105 |
| 4,921,135 | A * | 5/1990 | Pleet | B67D 1/0869 222/105 |
| 5,104,003 | A * | 4/1992 | Stecoza | B67D 3/0029 222/88 |
| 5,240,144 | A * | 8/1993 | Feldman | B67D 1/0462 222/105 |
| 5,251,787 | A * | 10/1993 | Simson | B67D 1/0462 222/394 |
| 5,529,220 | A * | 6/1996 | Credle, Jr. | B67D 1/08 222/400.7 |
| 5,947,339 | A * | 9/1999 | Boshears | B67D 1/0425 222/401 |
| 6,155,465 | A * | 12/2000 | Steiger | B67D 3/043 222/531 |
| 6,220,311 | B1 * | 4/2001 | Litto | B67D 1/0462 141/98 |
| 6,269,980 | B1 * | 8/2001 | Randall | B67D 3/0029 222/481.5 |
| 6,502,725 | B1 * | 1/2003 | Alexander | B67D 1/0456 222/481.5 |
| 6,571,977 | B2 * | 6/2003 | Goncalez | B65D 1/04 220/633 |
| 7,367,479 | B2 * | 5/2008 | Sitz | B65D 81/2053 222/400.7 |
| 7,819,286 | B2 * | 10/2010 | Antheil | B65D 77/06 222/105 |
| 9,284,177 | B2 * | 3/2016 | Litto | B67D 1/0878 |
| 10,258,940 | B2 * | 4/2019 | Van Damme | B67D 1/0891 |
| 11,091,360 | B2 * | 8/2021 | Christiansen | B67D 1/0884 |
| 11,434,124 | B2 * | 9/2022 | Bhutani | B67D 1/08 |
| 2003/0183249 | A1 * | 10/2003 | Nissinen | B67D 1/07 134/169 C |
| 2004/0226960 | A1 * | 11/2004 | Aguirre | B67D 1/0406 222/399 |
| 2006/0124665 | A1 * | 6/2006 | Prabucki | B67D 3/0029 222/129.1 |
| 2007/0157656 | A1 * | 7/2007 | Hall | B67D 1/0867 62/390 |
| 2009/0078721 | A1 * | 3/2009 | Hoffman | B65D 77/06 222/105 |
| 2010/0133292 | A1 * | 6/2010 | Ware | B67D 7/0261 222/64 |
| 2011/0036846 | A1 * | 2/2011 | Corbett | B65D 1/22 220/495.03 |
| 2013/0099021 | A1 * | 4/2013 | Taylor | B67D 1/0801 29/401.1 |
| 2014/0131380 | A1 * | 5/2014 | Pethe | B67D 7/0294 222/105 |
| 2015/0048117 | A1 * | 2/2015 | Lam | B67D 1/0462 222/386.5 |
| 2015/0344280 | A1 * | 12/2015 | Meinzinger | B67D 1/0829 222/82 |
| 2017/0022040 | A1 * | 1/2017 | Koretz | B67D 1/0891 |
| 2021/0139305 | A1 * | 5/2021 | Christiansen | B67D 1/07 |
| 2022/0144616 | A1 * | 5/2022 | Bach | B67D 1/0888 |

FOREIGN PATENT DOCUMENTS

| | | | |
|---|---|---|---|
| EP | 2192080 | | 6/2010 |
| JP | 03-056600 | U | 5/1991 |
| JP | 11-017519 | A | 1/1999 |
| JP | 2004-338742 | A | 12/2004 |
| JP | 2007-514468 | A | 6/2007 |
| JP | 2010-536669 | A | 12/2010 |
| JP | 2013-544724 | A | 12/2013 |
| WO | 9520540 | | 8/1995 |
| WO | 2004099060 | | 11/2004 |
| WO | 2005/053489 | A1 | 6/2005 |
| WO | 2007019848 | | 2/2007 |
| WO | 2007019849 | | 2/2007 |
| WO | 2007019850 | | 2/2007 |
| WO | 2007019851 | | 2/2007 |
| WO | 2007019853 | | 2/2007 |
| WO | 2009024147 | | 2/2009 |
| WO | 2010029122 | | 3/2010 |
| WO | 2010060946 | | 6/2010 |
| WO | 2010060949 | | 6/2010 |
| WO | 2011/006212 | A1 | 1/2011 |
| WO | 2012/071376 | A2 | 5/2012 |
| WO | 2013/026703 | A1 | 2/2013 |
| WO | 2013/113657 | A1 | 8/2013 |
| WO | 2015127470 | | 8/2015 |

OTHER PUBLICATIONS

International Search Report and Written Opinion issued in parent PCT Application No. PCT/EP2018/055191, dated May 4, 2018.

* cited by examiner

BEVERAGE DISPENSING SYSTEM, A BEVERAGE DISPENSING ASSEMBLY, A METHOD OF OPERATING A BEVERAGE DISPENSING SYSTEM AND A PRESSURE HOUSING

This application is a U.S. national phase application under 35 U.S.C. 371 of International Patent Application No. PCT/US2018/055191, filed on Mar. 10, 2018, which claims priority to EP Application No. 17160349.1, filed on Mar. 10, 2017, which are both incorporated herein by reference in their entireties.

The present invention relates to a beverage dispensing system, a beverage dispensing assembly, a method of operating a beverage dispensing system and a pressure housing.

BACKGROUND

Typically, beverage dispensing systems are used to dispense carbonated alcoholic beverages such as draught beer and cider. However, also non-alcoholic beverages such as soda and non-carbonated beverage such as wine and fruit juice may be dispensed using a beverage dispensing system. Beverage dispensing systems are mostly for professional users such as in establishments like bars, restaurants and hotels, however, increasingly also for private users such as in private homes.

Classical beverage dispensing systems comprise a fixed tapping line extending between a replaceable pressurized steel keg and a dispensing device comprising tapping valve having a beverage outlet and being controlled by a tapping valve. By operating the tapping handle, the tapping valve opens and the pressurized beverage is forced from the keg and out through the valve into a glass positioned below the beverage outlet. In-between each filling, the beverage kegs would have to be carefully cleaned, which has proven to be very costly. Insufficient cleaning may lead to unhygienic beverage kegs, which may in turn lead to health problems for the beverage consumer.

Modern beverage dispensing systems instead use collapsible kegs/containers made of plastic material. An example of such a beverage dispensing system using collapsible beverage kegs is the DraughtMaster™ system provided by the applicant company. Such beverage dispensing systems using collapsible beverage containers typically have the beverage containers installed in a pressure chamber. When dispensing beverage from the beverage dispensing system, a pressure fluid is allowed to enter the pressure chamber. The pressure fluid acts on the beverage containers and the beverage containers collapse as the beverage is drained from the beverage container, i.e. the volume of the beverage container is reduced corresponding to the amount of dispensed beverage.

Such collapsible beverage containers eliminates the need of transporting, storing and cleaning the empty beverage containers. However, there is still a need for keeping the other parts of the beverage dispensing system that comes in contact with the beverage clean, i.e. the tapping line and the tapping valve. Basically, two approaches exist for allowing the tapping line to remain hygienic and prevent buildup of residues, which may form a breeding ground for bacteria and other microorganisms. The first solution is to completely prevent any contact between the beverage and any fixed part of the beverage dispensing system. In practice, this involves using a collapsible and disposable beverage container, a disposable tapping line and a disposable tapping valve. The technology is presented in more detail in WO 2004/099060, WO 2007/019848, WO 2007/019849, WO 2007/019850, WO 2007/019851 and WO 2007/019853, all of them being filed by the present applicant company. As evident from the above publications, the disposable tapping lines and tapping valves may be used for beverage dispensing systems of all sizes.

The use of a disposable tapping line and a disposable tapping valve is, however, not always possible and/or may not be desired due to the added cost for the replacement of the disposables and the time needed for effectuating the replacement of the disposables. In many cases, in particular for larger facilities, it may be more desirable instead to use a fixed tapping line and tapping valve, and instead perform a periodic, e.g. once a day, cleaning of the tapping line and tapping valve.

Two different techniques of cleaning the tapping line and tapping valve exist, namely internal cleaning and external cleaning. In the first variant, internal cleaning, the beverage container is replaced with a cleaning container including one or more cleaning fluids, such as a cleaning fluid and a flushing fluid. The cleaning fluid is allowed to pass through the tapping line and tapping valve in the same way as the beverage. The technique is described in more detail in WO 2010/029122 filed by the applicant company.

In the second variant, external cleaning, a centralized cleaning unit is used, which is coupled to a three-way valve which may be placed in a dispensing mode in which beverage is supplied through the tapping line and tapping valve, and, a cleaning mode in which first a rinsing fluid and then a flushing fluid is supplied through the tapping line and tapping valve in order to clean the same. More details may be found in WO2009/024147, WO 2010/060946 and WO2010/060949, all filed by the applicant company.

In particular for permanent establishments having a high turnover, it may be cost- and time efficient to use fixed dispensing lines, which allow a very quick replacement of the beverage container. The cleaning of the tapping line and tapping valve may be performed every day after closing the establishment. On the other hand, establishments of a temporary nature such as fairs and events, and establishments having a lower turnover, such as private users and smaller bars and restaurants, may wish to avoid periodic cleaning and accept a slightly higher cost for the beverage container when it needs to be exchanged. In such cases, the disposable tapping lines and valves may be used.

The main drawback with the above technologies, i.e. the use of disposable tapping line and tapping valve versus the periodic cleaning of the tapping line and tapping valve, is that they are not mutually compatible, i.e. the user has to decide once and for all for one of the technologies. However, there may exist situations when the user desires a more flexible system, which is capable of being used both together with a cleanable dispensing line and with a disposable dispensing line. The user may e.g. like to use a fixed dispensing line for beverages having a high demand resulting in a frequent change of beverage container, and a disposable dispensing line for beverages having a lower demand and thus a less frequent change of beverage container.

In the past, a typical beverage dispensing establishment would have a couple of the most popular variants of draught beer and the remaining "special beers" which are not frequently ordered available only in bottles. Thereby the daily cleaning of a dispensing line and dispensing valve that is not frequently used every day is avoided. However, as draught beer is becoming more popular, there is a need for more beer variants to be available as draught, i.e. both beer variants that have a high turnover and those which have a lower turnover.

It is therefore an object according to the present invention to provide a modular dispensing system capable of handling both fixed dispensing lines and disposable dispensing lines within the same system, preferably with minimal conversion time needed to change between the two.

An advantage of providing a modular dispensing system as described above is that the production line of both beverage dispensing systems and beverage containers may be streamlined. For instance, the pressure chambers may be manufactured to be identical for use together with both a cleanable dispensing line and a disposable dispensing line, even in case the end user intends to use solely disposable dispensing lines or solely fixed dispensing lines.

SUMMARY OF THE INVENTION

According to a first aspect of the present invention, the above-mentioned object, need, advantage and more are achieved by a beverage dispensing system comprising:

- a pressure housing comprising a first housing part and a second housing part being connected to or being connectable to the first housing part for establishing an inner chamber when the first housing part and the second housing part are being connected together, the first housing part having a connector aperture,
- a pair of connectors, both being connectable to the connector aperture of the first housing part in a pressure-tight sealing connection, the pair of connectors comprising a first connector having a through-going hole for allowing guiding a first tapping line from within the inner chamber and through the through-going hole leading externally from the pressure chamber, and a second connector being connected to or being connectable to a second tapping line leading externally from the pressure chamber, and
- a pair of beverage containers, both having a body part for accommodating a carbonated beverage and a beverage outlet for allowing extraction of the carbonated beverage from the beverage container, both beverage containers having a closure for closing off the beverage outlet and for sealing against a sealing element of the pressure chamber or one of the pair of connectors for establishing an interspace between the outer wall of the body part and the inner wall of the inner chamber, a first beverage container of the pair of beverage containers comprising the first tapping line communicating with the beverage outlet via the closure and a second beverage container of the pair of beverage containers having an openable seal at the closure for establishing connection from the beverage outlet to the second connector, and,
  - a pressure inlet communicating with the interspace for allowing admission of a pressure medium thereto.

The present beverage dispensing system is provided for allowing beverage dispensing both with a disposable dispensing line and dispensing valve and with a fixedly mounted dispensing line and dispensing valve. The pressure housing comprises a first housing part and a second housing part. When the parts are connected together, a pressure-tight inner chamber is established. Hence, as used herein, the terms "inner chamber" and "pressure chamber" are used interchangeably. The pressure housing is made of pressure proof materials, such as metal or rigid plastic. The connector aperture of the first part is adapted for receiving any one of the connectors, i.e. only one connector should be used at a time. The connector aperture forms an access point for accessing the beverage outlet of the beverage container, and the beverage accommodated therein. The connectors are interchangeable in order to adapt the beverage dispensing system to a disposable tapping line or a fixed tapping line, respectively.

Both connectors are insertable into the connector aperture and may be fixated to the connector aperture in a sealed and pressure-tight fit. Preferably, the connector is fixated to the connector aperture e.g. by a screw fit, bayonet fit or the like. The first connector is only usable together with a disposable tapping line and simply provides a through-going hole for guiding the disposable tapping line from the inside of the pressure housing to the exterior. The second connector is only usable together with the second tapping line, which is normally constituted by a fixed tapping line, i.e. a non-disposable tapping line that forms an integral part of the beverage dispensing assembly. The connection between the second tapping line and the second connector is pressure-tight and may be e.g. a screw connection. The second connector may preferably also be able to interact with the openable seal. For instance, in case the openable seal is a breakable seal, the second connector may include a piercing member, or in case the openable seal is a valve, the second connector may be adapted for opening the valve as the second connector connects to the closure and/or beverage outlet.

Both of the beverage containers are blow moulded and of essentially identical shape and the volume is to be adapted to the volume of the inner chamber. This allows for mass production of the beverage containers and the pressure housing. The pressure housing and the corresponding beverage containers may be provided in different sizes. The closure of the beverage container closes off the beverage outlet for both of the beverage containers. The closures of both container types may also provide sealing against its corresponding connector, or alternatively, the pressure chamber includes a sealing element, which may seal against the closure. The sealing element may be sealing against the first housing part.

The closure also marks the difference between the container types, i.e. the first of the closure types includes the first tapping line being a disposable tapping line to be used with the first connector, whereas the second closure type is used in the second container type and defines an openable seal. The first tapping line is typically permanently attached to the closure, however, it may also be provided as a separate disposable part, which is attached to the closure shortly before use, e.g. using a click connection mechanism.

The closure types are made from the same basic base part which forms the keg closure and which may seal against the pressure chamber. It also provides a flange onto which the pressure chamber may rest and which may be used for carrying the beverage container. The mouthpart of the beverage container, onto which the closure is fixed in a fluid-tight, stable and permanent connection, is typically the same of all sizes of beverage container and thus, the sole difference between the variant of the closure may be whether an integrated, disposable tapping line or an openable seal is used. The above parts, i.e. the tapping line or seal, may be applied to a uniform base part usable for all modular dispensing systems as described herein.

Thus, identical standardized base parts may be produced having a mouthpart, which may connect to standardized neck parts of beverage container that may have different sizes. The base parts have a centrally located bore, which may receive coupling parts having either an integrated dispensing line or a breakable seal. The coupling parts may preferably be press fitted or clicked in place, however, other methods such as screw fits and welds are feasible.

One of the connectors of the pair of connectors may be installed permanently, e.g. by welding, in the connector aperture, such that the beverage dispensing system is permanently made to be used with the specific container type. Alternatively, the user is provided with both of the connectors allowing the user to change connector type on site in order to be able to modify the beverage dispensing system to be used with both container types according to consumption of a particular beverage and thereby optimize the time spent on cleaning.

The pressure inlet is adapted for receiving a pressure medium and transport the pressure medium to the interspace between the outer wall of the body part and the inner wall of the inner chamber. The interspace is typically made as small as possible, e.g. a few millimeters of width, in order to allow a tight fit between the beverage container and the inner chamber. The pressure inlet may form part of e.g. the first housing part, the second housing part or the connector, and may optionally include a one-way valve and/or overpressure valve. The pressure medium is typically air; however, any fluid would be feasible, such as $CO_2$, $N_2$, water etc.

According to a further embodiment of the first aspect, the first housing part and a second housing part are separable for inserting and removing the beverage containers. In some embodiments, the housing parts are separable such that the second housing part or the first housing part acts as a lid. The housing parts may be of different size. The housing parts, e.g. the second housing part, may also be provided in different sizes in order to be able to manufacture pressure housings of different size using a common first housing part.

According to a further embodiment of the first aspect, the first housing part and a second housing part are permanently connected, one of the first and second housing parts comprises a lid for inserting and removing the beverage containers. As an alternative to separable housing parts, the housing parts may be permanently connected, e.g. being welded together or screwed or bolted together permanently, and one of the housing parts comprises a lid.

According to a further embodiment of the first aspect, the beverage dispensing system comprises a third housing part acting as a replacement of the second housing part, having a different volume than the second housing and being connectable to the first housing part for establishing the inner chamber. In this way, the same first housing part may be used together with different further housing parts of different size. In this way, the beverage dispensing system may be modified to a specific beverage container size, e.g. 5 liters, 10 liters or 20 liters. The second housing part may even be exchangeable by the user with a third housing part of different size, e.g. by providing a screw mount.

According to a further embodiment of the first aspect, the inner chamber defines between 2 and 100 litres, preferably between 5 and 50 litres, more preferably between 10 and 25 litres. The above volumes constitute typical volumes of the inner chamber. The beverage containers have a corresponding size, being slightly smaller for a tight fit inside the inner chamber.

According to a further embodiment of the first aspect, the beverage dispensing system further comprises a compressor and a gas cylinder selectively connectable to the pressure inlet for providing the pressure medium to the interspace. In order to make the system more modular, the pressure inlet and the beverage dispensing systems may be compatible with different pressurization units. A compressor may be used when access to either mains power or battery power is available to power the compressor allowing it to pressurize the inner chamber by taking atmospheric air from the outside, pressurize it and inject the pressurized air into the interspace of the inner chamber. A gas cylinder may be used where no mains power is available and/or batteries are considered an inconvenient choice. The gas cylinder is pre-loaded with a pressurized gas, e.g. air, nitrogen, carbon dioxide or the like.

According to a further embodiment of the first aspect, the beverage dispensing system further comprises a pass through cooler for cooling the first tapping line or the second tapping line, a refrigerator for accommodating or being integrated with the pressure housing, and an ice container for accommodating a solid cooling block including e.g. ice, dry ice, glycol, liquid nitrogen etc. In order to make the system even more modular, it may be compatible with different cooling units. One solution is to include refrigeration of the complete inner chamber, including the beverage container and the beverage accommodated therein, to the beverage consumption temperature, e.g. 2-5°. Another option is to allow the inner chamber, including the beverage container and the beverage accommodated therein, to assume a temperature higher than the consumption temperature, i.e. room temperature and using a pass through cooler to cool the beverage to the consumption temperature just before dispensing. Yet another solution us to use a cooling medium, e.g. ice, dry ice, glycol, liquid nitrogen, allowing a non-electrical solution.

According to a further embodiment of the first aspect, the pressure housing is thermally insulated. The thermal insulation may be used in conjunction with a cooling unit in order to save energy, or alternatively, the cooling unit is dispensed with and instead a thermal insulation is used in conjunction with pre-chilled beverage containers in order to save weight in e.g. carry-on appliances.

According to a further embodiment of the first aspect, the beverage dispensing system further comprises a first electric power unit including a mains supply and a second power unit including a battery supply, and, optionally, a third power supply including a solar power supply. In order to further enhance the modularity of the system, it may be compatible with different power supplies. For fixed indoor installations, a mains power supply, e.g. 115V or 230V AC household supply, is preferred since it offers essentially unlimited power to the system for powering both cooling and pressurization units as well as other features such as lighting etc. Batteries may advantageously be used in mobile appliances. The batteries may e.g. be rechargeable by the use of a mains supply and a power converter. Solar power may be used for directly powering the beverage dispensing system, however, due to the limited output of solar cells when no direct sunlight is available it is mostly considered an auxiliary power unit to be used in conjunction with rechargeable batteries.

According to a further embodiment of the first aspect, the second connector including a three-way valve connected to the second beverage container and a cleaning unit including a cleaning fluid, the three-way valve defining a first position allowing extraction of the carbonated beverage from the beverage container while preventing extraction of the cleaning fluid from the cleaning unit, and, a second position allowing extraction of the cleaning fluid from the cleaning unit while preventing extraction of the carbonated beverage from the beverage container. Fixed installations of beverage dispensing systems including more than one pressure housing typically include a cleaning unit in conjunction with a three-way valve which may be set in one of two positions, in which the first position allows dispensing of beverage, whereas the second position allows a quick and efficient cleaning by allowing dispensing of cleaning fluid while preventing the cleaning fluid from entering the beverage container, and vice versa. The three-way valve may be remotely operated from the bar counter. The cleaning fluid may be stored in a tank and pumped through the tapping line when the three-way valve is in the correct position. Three-way valve should be understood to mean that the valve has one beverage inlet connected to the beverage container, one cleaning fluid inlet connected to the cleaning unit, and a common outlet connected to the tapping line. The three-way valve and the second connector typically form a single component, however, it may also be considered to use two components, which are connectable to form a single component.

According to a further embodiment of the first aspect, the beverage dispensing system comprises wheels, a bar counter and a tapping device connected to the tapping line and positioned on the bar counter, or alternatively, wherein the beverage dispensing system comprises an integrated tapping device connected to the tapping line. In the present embodiment, the beverage dispensing system is mobile, e.g. in the first alternative by providing wheels, or in the second alternative by having a compact size.

According to a further embodiment of the first aspect, the beverage dispensing system comprises carrying straps for being carried around by a user and a hand held tapping device connected to the tapping line. In the present embodiment, the beverage dispensing system is adapted for being carried by a user by providing straps and a handheld tapping device.

According to a second aspect of the present invention, the above-mentioned object, need, advantage and more are achieved by a beverage dispensing assembly comprising a plurality of beverage dispensing systems as defined in any of the embodiments of the first aspect, such as between 3-20 systems, all tapping lines being lead in a common python to a common dispensing location and connected to a respective tapping device at the common dispensing location, the common dispensing location preferably constituting a common font. The present embodiment allows multiple beverage dispensing systems according to the first aspect to be used in the same setup in order to be able to provide several draught beverages. The beverage dispensing systems may also be set up in parallel, allowing several tapping lines to merge into a common tapping line and a common tapping device, allowing an extended dispensing of the same beverage without having to change beverage container. A common cleaning unit may be used in order to be able to clean all tapping lines at the same time. The pressure housings may be located remotely from the dispensing location, i.e. in a cellar or chilled warehouse.

According to a third aspect of the present invention, the above-mentioned object, need, advantage and more are achieved by a method of operating a beverage dispensing system, the method comprising the steps of:

providing a pressure housing comprising a first housing part and a second housing part being connected to or being connectable to the first housing part for establishing an inner chamber when the first housing part and the second housing part are being connected together, the first housing part having a connector aperture, providing a pair of connectors comprising a first connector having a through-going hole and a second connector, providing a pair of beverage containers, both having a body part accommodating a carbonated beverage, a beverage outlet and a closure closing off the beverage outlet, a first beverage container of the pair of beverage containers comprising a first tapping line communicating with the beverage outlet via the closure and a second beverage container of the pair of beverage containers having an openable seal at the closure, and establishing a first operational mode by connecting the first connector to the connector aperture of the first housing part in a pressure-tight sealing connection, accommodating the first beverage container within the inner space, sealing the closure of the first beverage container against a sealing element of the pressure chamber or the first connector for establishing an interspace communicating with the pressure inlet between the outer wall of the body part of the first beverage container and the inner wall of the inner chamber, guiding the first tapping line from within the inner chamber and through the through-going hole leading externally from the pressure chamber, admitting a pressure medium into the interspace via the pressure inlet, and, extracting the carbonated beverage from the beverage container via the beverage outlet, or establishing a second operational mode by connecting the second connector to the connector aperture of the first housing part in a pressure-tight sealing connection, accommodating the second beverage container within the inner space, sealing the closure of the second beverage container against a sealing element of the pressure chamber or the second connector for establishing an interspace between the outer wall of the body part of the second beverage container and the inner wall of the inner chamber, connecting the second connector to the openable seal and to a second tapping line leading externally from the pressure chamber, admitting a pressure medium into the interspace via a pressure inlet, and, extracting the carbonated beverage from the beverage container via the beverage outlet.

The present method according to the third aspect may preferably be used in conjunction with the system according to the first aspect. The two operational modes may be selected according to the need of the user. The first operational mode is to be used together with a disposable tapping line and may thus be used in a beverage dispensing system where no cleaning of the tapping line is desired, e.g. in mobile systems and for beverages which have a relatively low demand, whereas the second operational mode is to be used together with a fixed tapping line in e.g. stationary systems, assemblies including a plurality of systems, and for beverages having a high demand. Only one operational mode may be used at a time, however, the system may at any time be modified by restoring the system to the original state, i.e. releasing the pressure and removing the beverage container and connector, and thereafter follow the steps of the other operational mode.

According to a fourth aspect of the present invention, the above-mentioned object, need, advantage and more are achieved by a pressure housing comprising a first housing part and a second housing part being connected to or being connectable to the first housing part for establishing an inner chamber when the first housing part and the second housing part are being connected together, the first housing part having a connector aperture, the pressure housing being compatible with a pair of connectors, both being connectable to the connector aperture of the first housing part in a pressure-tight sealing connection, the pair of connectors comprising a first connector having a through-going hole for allowing guiding a first tapping line from within the inner chamber and through the through-going hole leading externally from the pressure chamber, and a second connector being connected to or being connectable to a second tapping line leading externally from the pressure chamber, the pressure housing being further compatible with a pair of beverage containers, both having a body part for accommodating a carbonated beverage and a beverage outlet for allowing extraction of the carbonated beverage from the beverage container, both beverage containers having a closure for closing off the beverage outlet and for sealing against a sealing element of the pressure chamber or one of the pair of connectors for establishing an interspace between the outer wall of the body part and the inner wall of the inner chamber, the interspace communicating with a pressure inlet for allowing admission of a pressure medium to the interspace, a first beverage container of the pair of beverage containers comprising the first tapping line communicating with the beverage outlet via the closure and a second beverage container of the pair of beverage containers having an openable seal at the closure for establishing connection from the beverage outlet to the second connector.

The pressure housing according to the fourth aspect may be used together with any of the first, second and third aspects.

DETAILED DESCRIPTION OF THE DRAWINGS

Figure 1:
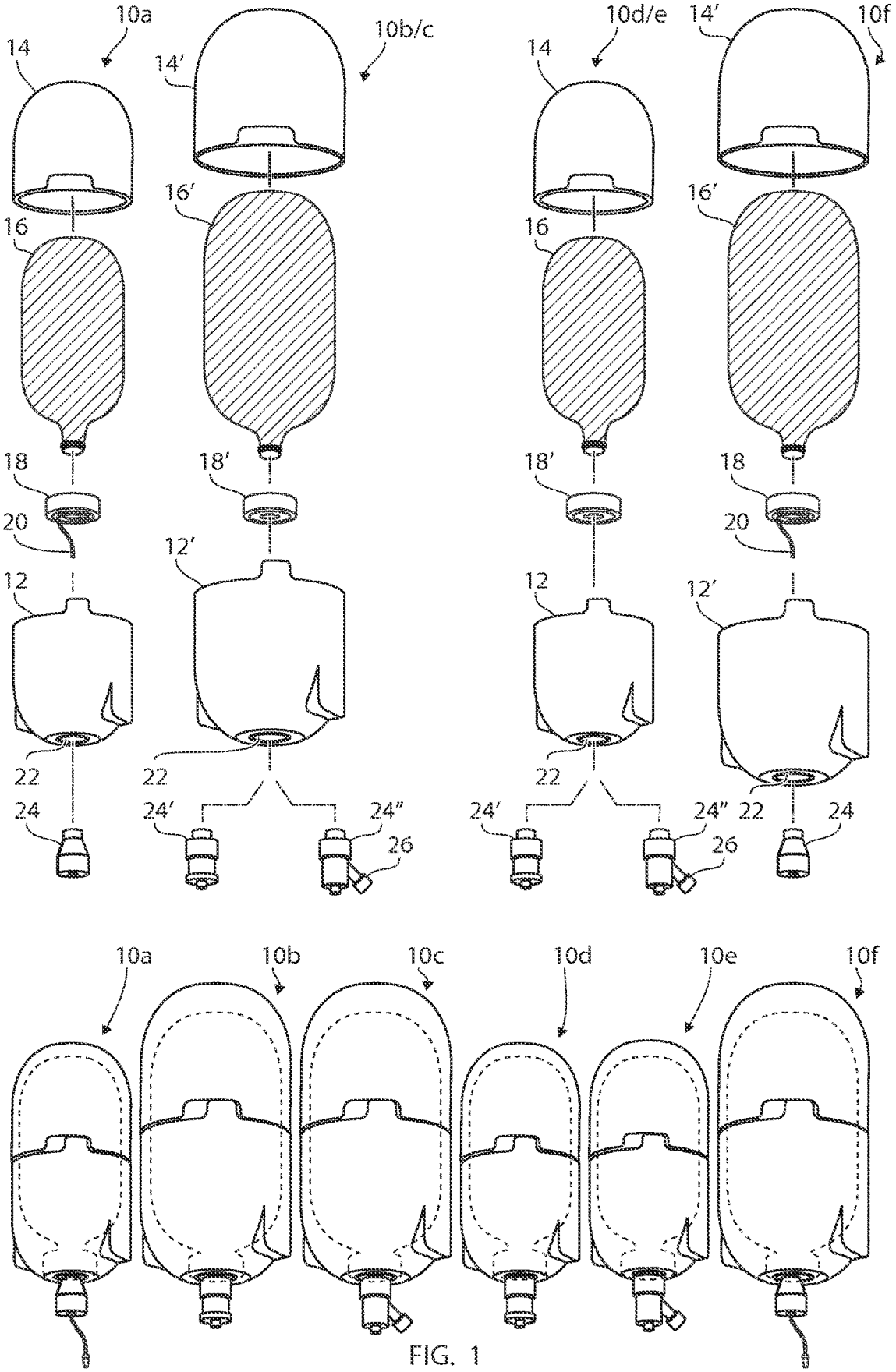
FIG. 1 is an overview of systems and modules for a modular beverage dispensing system.

FIG. 1 shows an overview of some modules for a modular beverage dispensing system 10*a-f*. Each of the beverage dispensing systems 10*a-f* comprises a pressure housing having a first part 12 12' and a second part 14 14'. The first part 12 12' and the second part 14 14' are connectable for establishing an inner space (inner chamber) for accommodating a beverage container 16 16'. The first part 12 12' and the second part 14 14' are provided in different sizes in order to be able to establish inner spaces of different sizes for being able to accommodate beverage containers 16 16' of corresponding sizes. The first part 12 12' and the second part 14 14' may be separated, e.g. via a screw coupling, for removing the empty beverage container 16 16', or alternatively another form of lid is provided. The pressure housing is made of a rigid and pressure-tight material such as metal or plastic.

The beverage container 16 16' is collapsible and comprises a pressurized beverage, such as beer. The beverage container 16 16' exists in different sizes of which two versions, a large 16' and a small 16, have been shown here, representing e.g. a 10 liters and 20 liters container. The beverage container 16 16' is closed off by a closure 18 18'. The closure exists in two versions, first closure 18 having an integrated, disposable tapping line 20 and a second closure 18' excluding a tapping line but having an openable seal. Both closures 18 18' are compatible with any beverage container 16 16'. Both closure 18 18' and beverage container 16 16' are disposable and typically made of a polymeric material.

The first part 12 12' of the pressure housing comprises an aperture 22 for accommodating a connector 24 24' 24". The connector 24 24' 24" comes in three variants, all of which may be accommodated in the aperture 22 of any of the pressure housings. The first connector variant 24 is compatible with the first closure variant 18 and provides a conduit for the tapping line 20. The second connector variant 24' and the third connector variant 24" are compatible with the second closure variant 18' and provide an interface between the openable seal of the closure 18' and an external tapping line (not shown). The second connector variant 24' and the third connector variant 24" are identical except that the third connector variant 24" includes a three-way valve and a cleaning inlet 26 for connecting an external cleaning unit (not shown) for circulating a cleaning fluid through the external tapping line. All of the connectors 24 24' 24" seal against the first part of the pressure housing 12 12' 14 14'. All of the closures 18 18' seal against either the connector 24 24' 24" or the first part of the pressure housing 12 12', or both.

The resulting beverage dispensing system 10*a-f* composed of the above described modules forms six distinct embodiments a-f of the beverage dispensing system: a. small pressure housing for beverage containers with integrated tapping line, b. large pressure housing for beverage containers using an external tapping line, c. large pressure housing for beverage containers using an external tapping line and having external cleaning, d. small pressure housing for beverage containers using an external tapping line, e. small pressure housing for beverage containers using an external tapping line and external cleaning, f. large pressure housing for beverage containers with integrated tapping line.

FIGS. 2A-F show further modules, which can be used for composing a dedicated beverage dispensing system fulfilling the need of the user. All of the modules described below are generally combinable with any of the systems described above in order to establish extended modular beverage dispensing systems or beverage dispensing assemblies. The beverage dispensing system is considered to encompass a pressure housing, a pressure inlet, a connector and a beverage container adapted for the specific connector and housing. The word "module" is used herein for describing a distinct part included in the system, such as a pressure housing alone or a connector alone, and also parts that are used together with the beverage dispensing system to extend the system or to form a beverage dispensing assembly. The expression "beverage dispensing assembly" is used for the combination of one or more pressure housings with associated connectors and further modules for being able to dispense beverage.

The first line in the FIGS. 2A-F show the resulting beverage dispensing system 10*a-f* composed of the pressure housings and connectors presented in FIG. 1. The second line shows pressurization modules providing a selection of an air compressor 28 or a pre-pressurized external gas cylinder 30. The third line shows cooling modules providing a selection of a refrigerator 32, a pass through cooler 34, a pre-cooler together with insulation 36 for the pressure housing, and ice blocks such as dry ice. The fourth line shows tapping modules providing a selection of a portable tapping unit 40, an integrated tapping unit 42, a separate tapping unit 44, also known as a tapping rod, and a multiple tapping unit 46 including several taps on the same rod. The fifth line shows power modules providing a selection of no power 48, i.e. a completely passive unit, battery power 50, e.g. lithium batteries, AC mains power 52, typically 115V or 230, 50 Hz or 60 Hz household power or solar power 54.

Figure 2A:
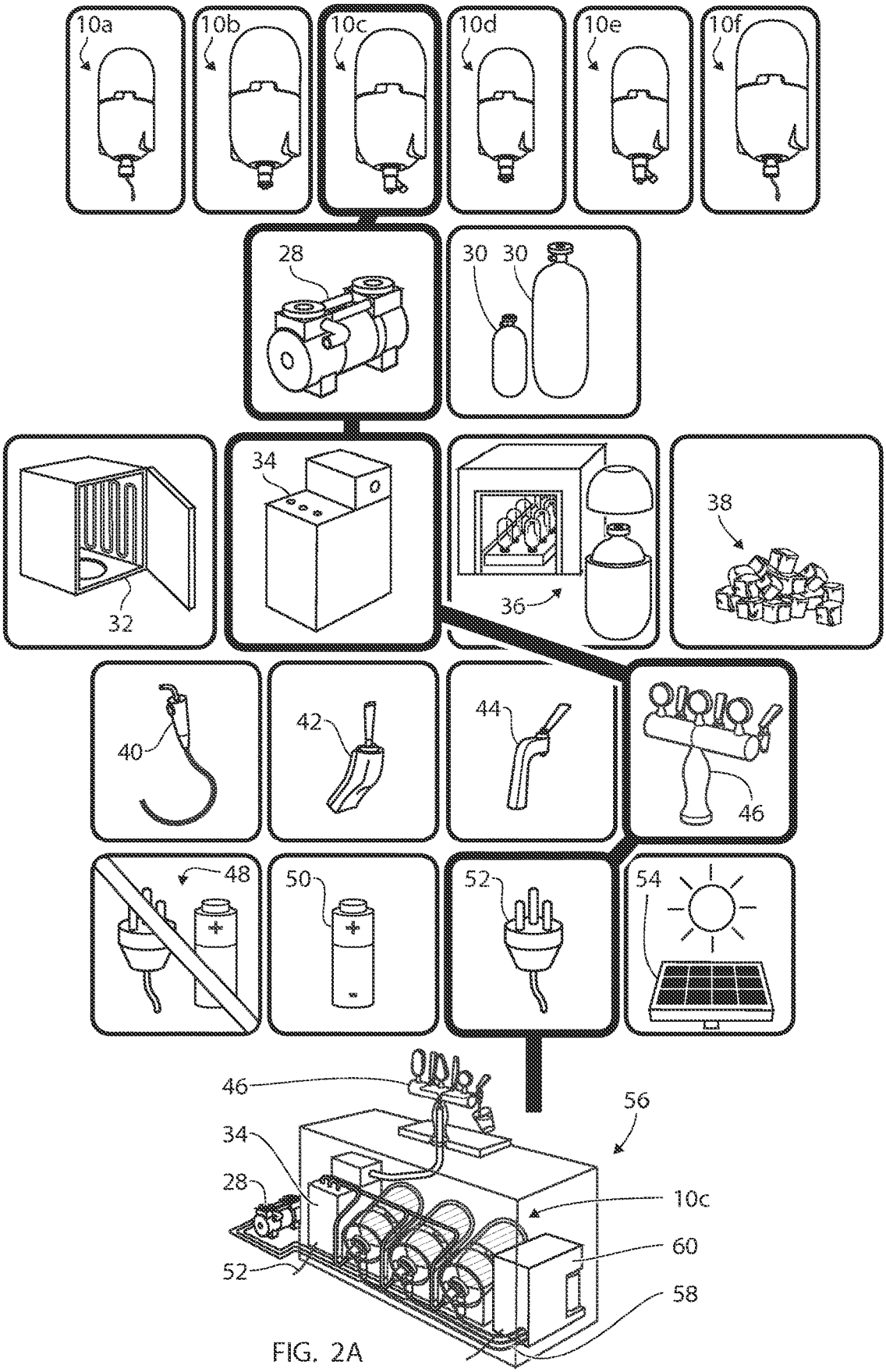
FIG. 2A is a multi chamber beverage dispensing system including cooling and cleaning units.

FIG. 2A shows a large beverage dispensing assembly 56 comprising multiple large beverage dispensing systems 10*c* for use in a large establishment, each connected to a fixedly installed tapping line 58. The beverage dispensing assembly 56 including an air compressor 28 for providing pressurization to the pressure housings and pass through cooling unit 34 through which all of the tapping lines 58 are connected to said cooling unit 34, and a cleaning unit 60 which is connected to the cleaning inlet 26 of the connector 24". It further comprises a multiple tapping unit 46 for dispensing from each of the beverage dispensing systems 10*c*. The assembly is connected to the AC mains 52.

Figure 2B:
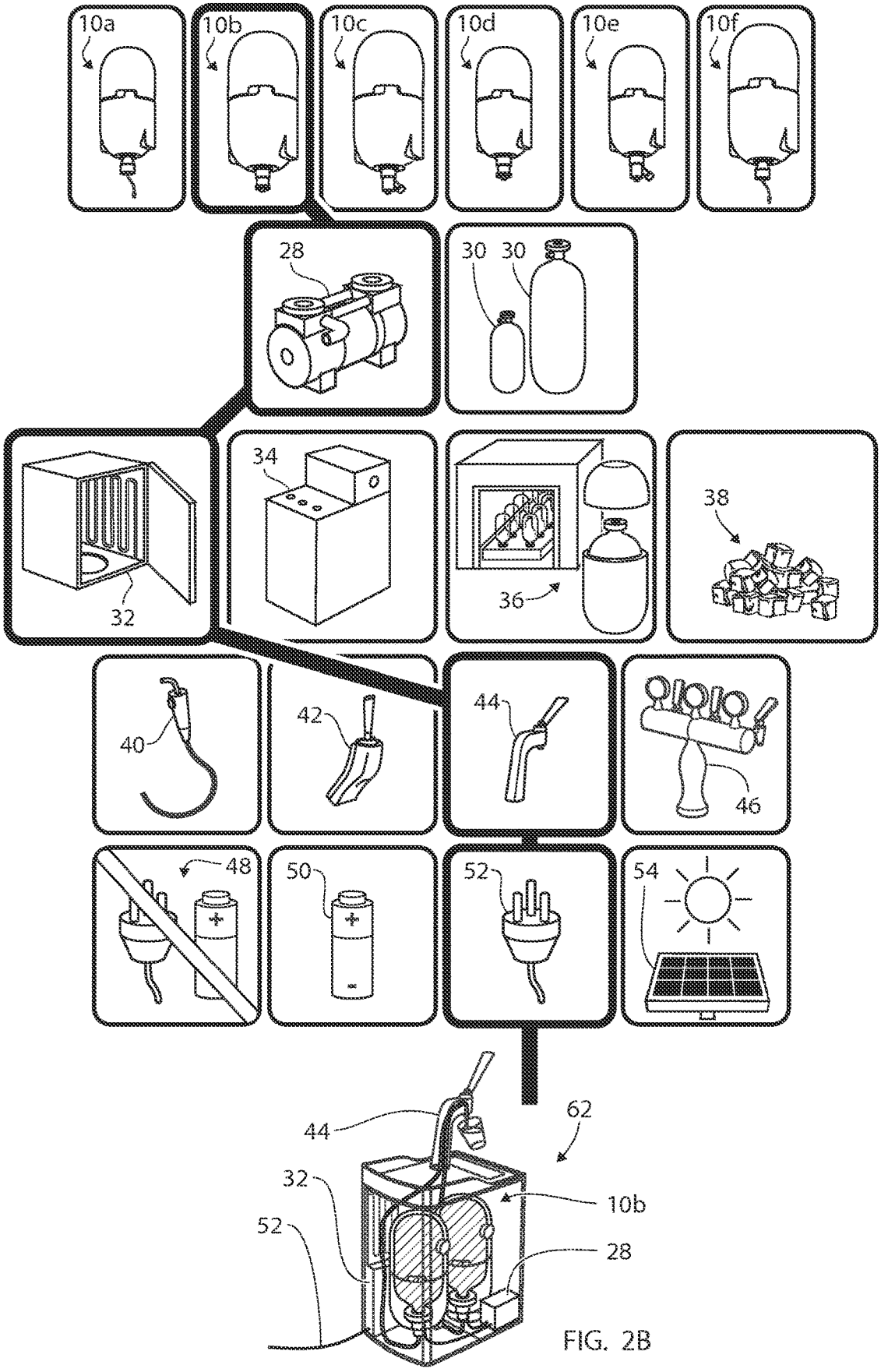
FIG. 2B is a stationary beverage dispensing system included in a refrigerator.

FIG. 2B shows a small stationary beverage dispensing assembly 62 for use e.g. in a smaller establishment. The assembly 62 includes a pair of large beverage dispensing systems 10*b* included in a refrigerator 32. The assembly includes an air compressor 28 for providing pressurization to the pressure housings, and a common tapping line 58 leading to a common tapping rod 44. The assembly is connected to the AC mains 52. Cleaning of the tapping line 58 may be performed by using a cleaning container (not shown).

Figure 2C:
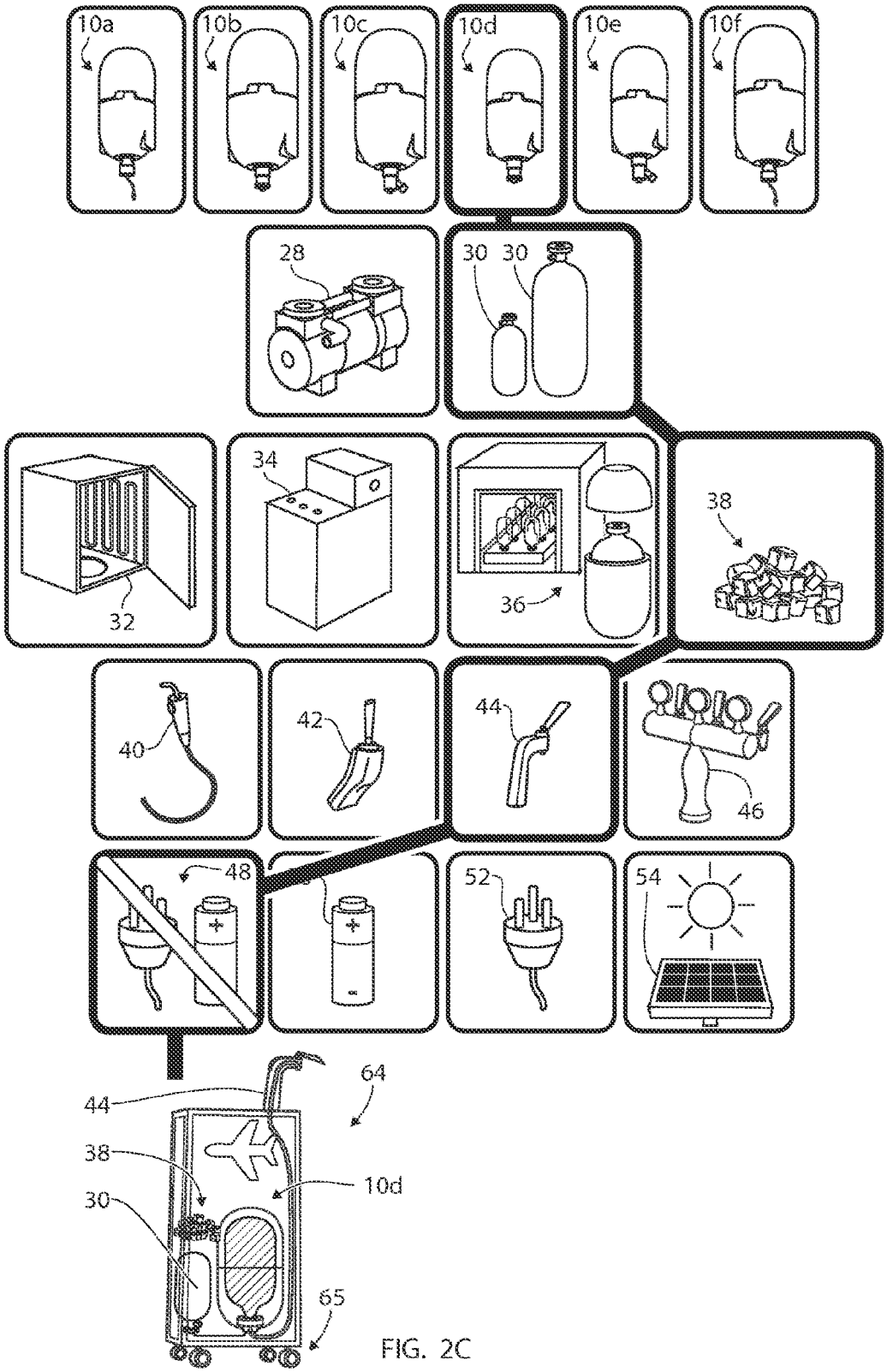
FIG. 2C is a mobile beverage dispensing system having a gas cylinder and an ice container.

FIG. 2C is an airplane trolley beverage dispensing assembly 64, preferably for use in airplanes and other means of transport. The beverage dispensing assembly 64 comprises one small beverage dispensing system 10*d*. The beverage dispensing assembly 64 uses no electrical power 48 but instead uses a gas cylinder 30 for providing the dispensing pressure, and an ice container 38, preferably filled with dry ice, for providing cooling. The tapping line 58 may be cleaned by using a cleaning container (not shown). The beverage dispensing assembly 64 comprises wheels 65.

Figure 2D:
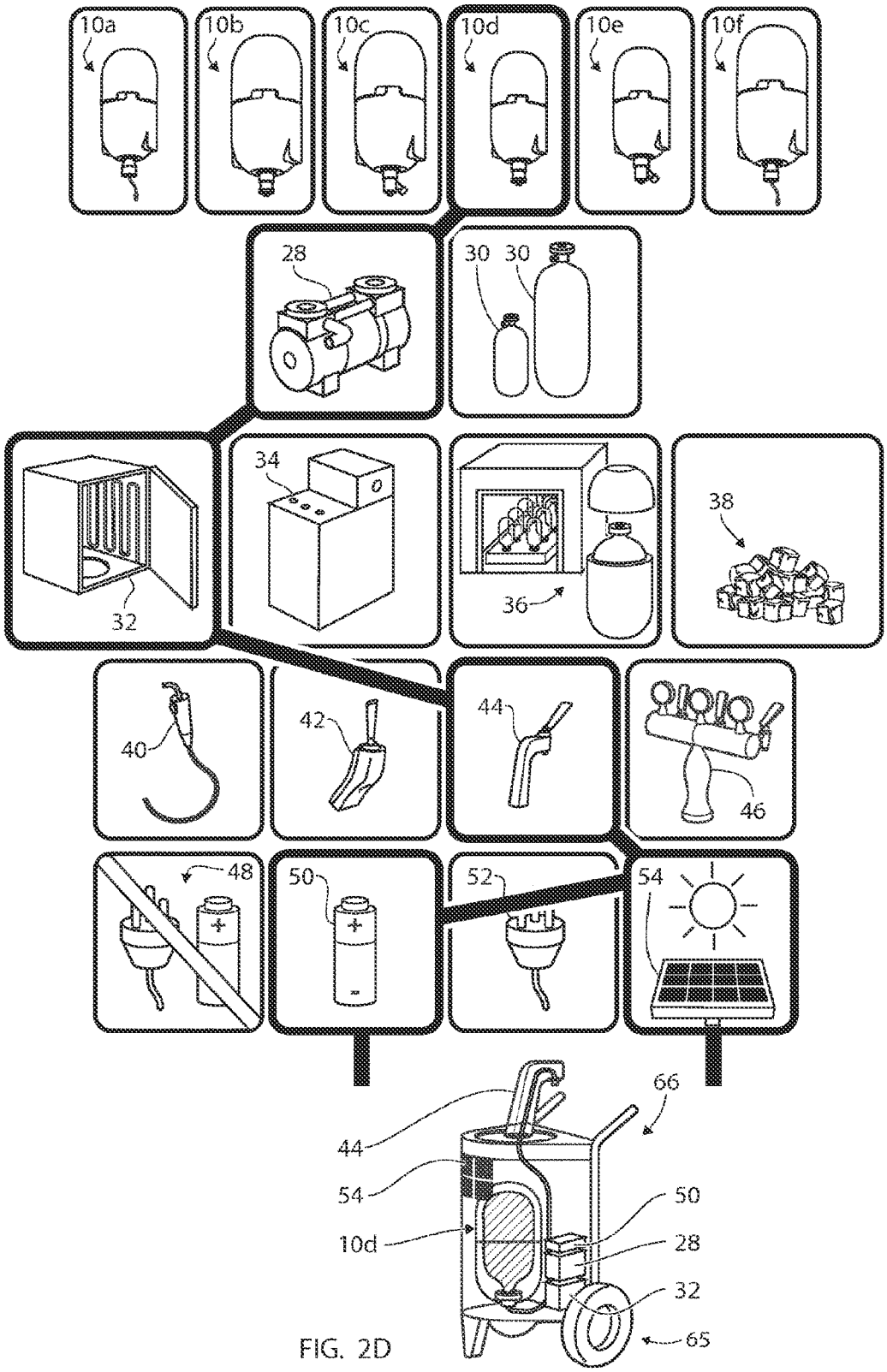
FIG. 2D is a mobile beverage dispensing system having a compressor and solar cells.

FIG. 2D is a small mobile beverage dispensing assembly 66 for use at e.g. sporting events, parties and similar social happenings. The beverage dispensing assembly 66 comprises one small beverage dispensing system 10*d* and has a compressor 28 and a refrigerator 32. It further comprises a tapping unit 44 and is powered by batteries 50 in combination with solar cells 54. The beverage dispensing assembly 66 comprises wheels 65.

Figure 2E:
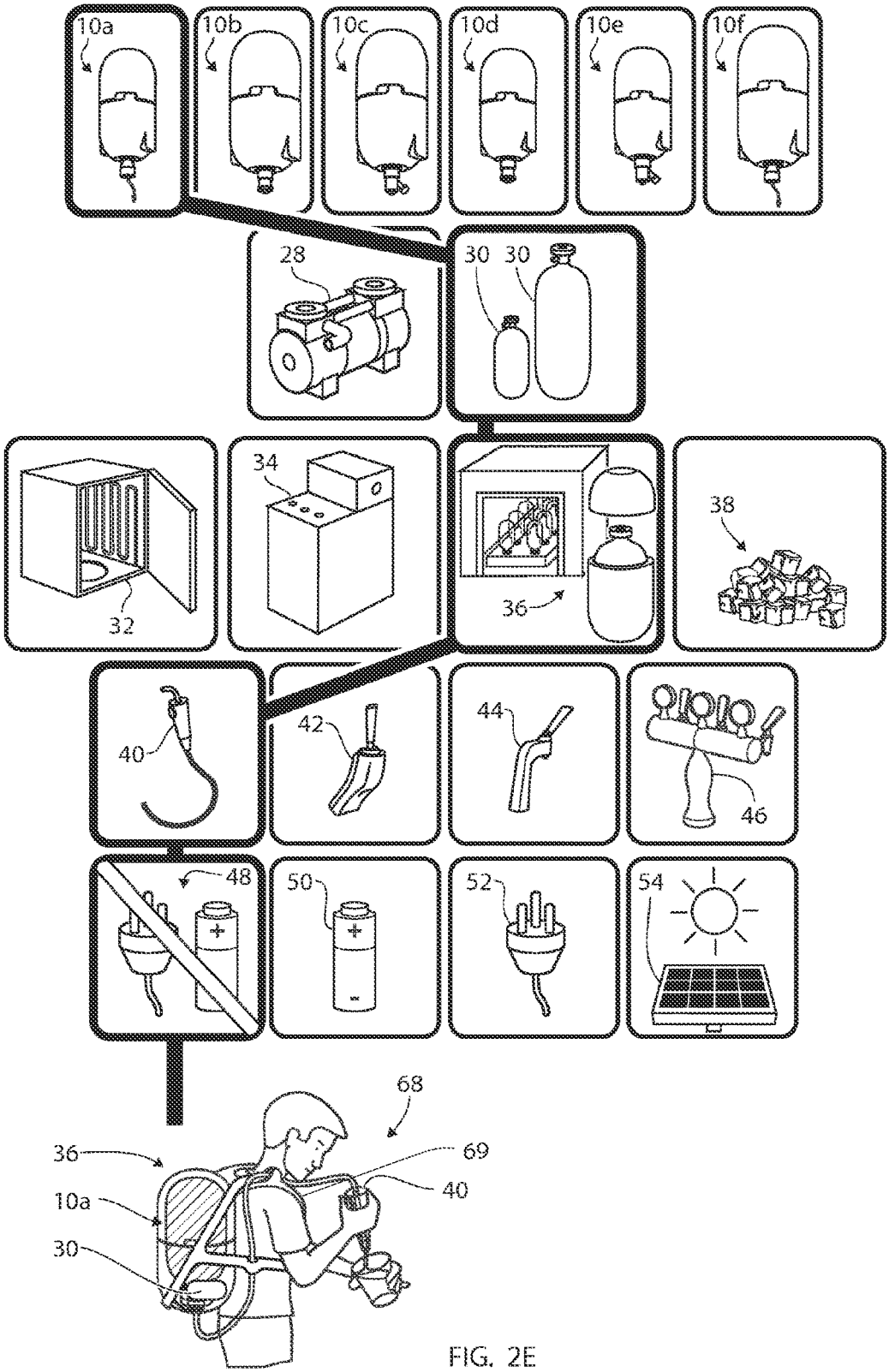
FIG. 2E is a is a carry-on beverage dispensing system having straps

FIG. 2E is a carry-on beverage dispensing assembly 68 having carry-on straps 69 for being used at similar events as the system described above. It comprises one small beverage dispensing system 10*a* having an integrated tapping line. The beverage dispensing assembly 68 uses no electrical power 48 but instead uses a gas cylinder 30 for providing the dispensing pressure, and a pre-cooled beverage container in combination with an insulated pressure housing in order to keep the beverage cool, while reducing the weight of the assembly sufficiently for allowing it to be carried by a person.

Figure 2F:
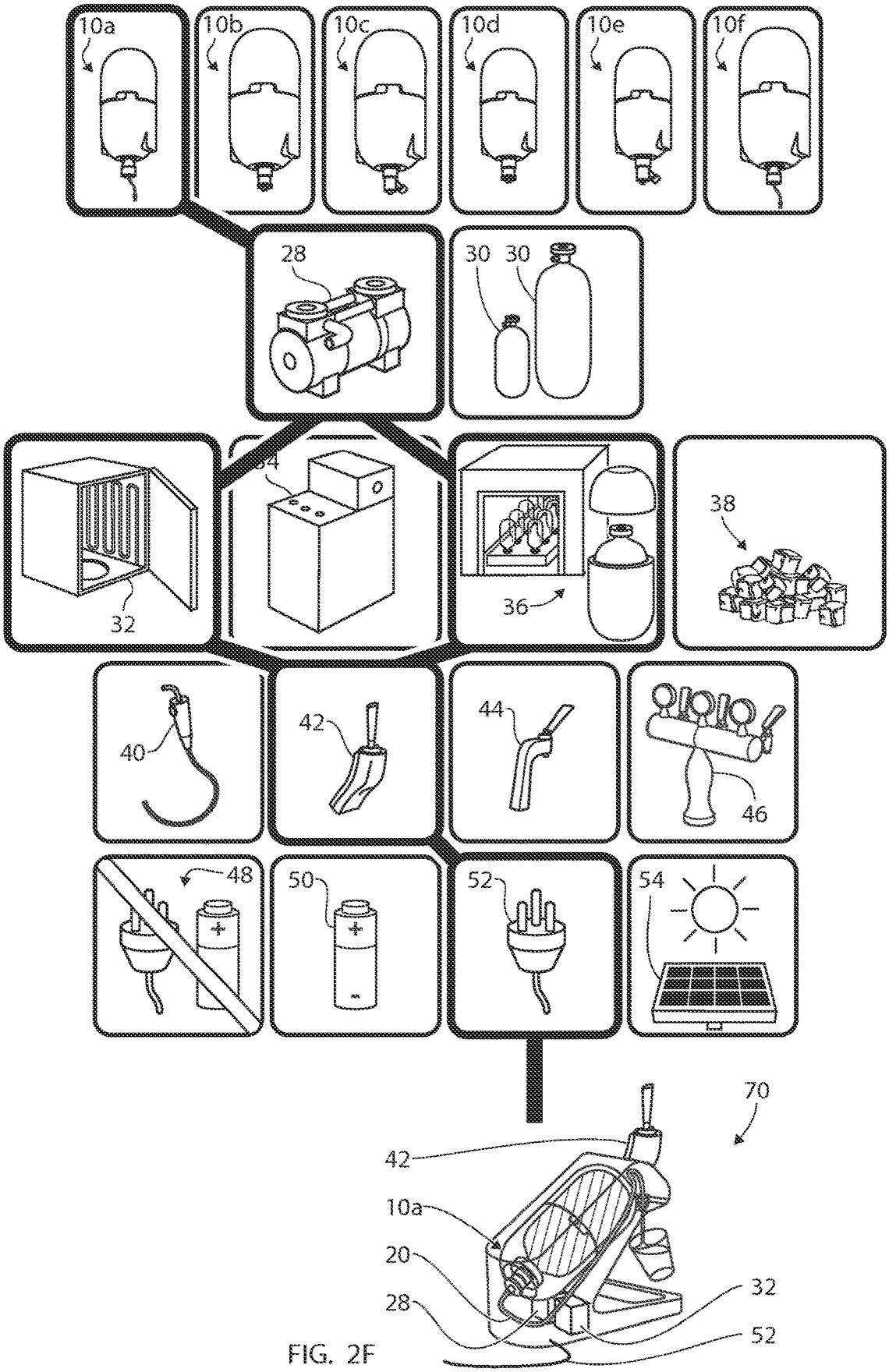
FIG. 2F is a tabletop beverage dispensing system.

FIG. 2F is a tabletop beverage dispensing assembly 70, for use in private homes and in small establishments wishing a flexible dispensing solution. The beverage dispensing assembly 70 comprises one small beverage dispensing system 10*a* having an integrated tapping line. The beverage dispensing assembly 70 further has a compressor 28 and a refrigerator 32, powered by AC mains power 52. It further comprises an integrated tapping unit 42.

The specific embodiments shown in connection with FIGS. 2A-F are construed to be examples of combinations of systems and modules, and it is understood that a skillful individual would be able to derive numerous further combinations of the above system and modules in order to realize further systems and assemblies.

LIST OF PARTS WITH REFERENCE TO THE FIGURES

10. Beverage dispensing system
12. First part of pressure housing
14. Second part of pressure housing
16. Beverage container
18. Closure
20. Tapping line
22. Aperture
24. Connector
26. Cleaning unit inlet
28. Compressor
30. Gas cylinder
32. Refrigerator
34. Pass through cooling
36. Pre-cooling and insulation
38. Ice cooling
40. Portable tapping unit
42. Integrated tapping unit
44. Separate tapping unit
46. Multiple tapping unit
48. No power
50. Battery
52. AC mains
54. Solar power
56. Large beverage dispensing assembly
58. Fixed tapping line
60. Cleaning unit
62. Small stationary beverage dispensing assembly
64. Airplane trolley beverage dispensing assembly
66. Small mobile beverage dispensing assembly
68. Carry-on beverage dispensing assembly
70. Table-top beverage dispensing assembly

The invention claimed is:

1. A beverage dispensing system comprising:

a pressure housing comprising a first housing part and a second housing part being connected to or being connectable to said first housing part for establishing an inner chamber when said first housing part and said second housing part are being connected together, said first housing part having a connector aperture, a pair of interchangeable connectors, both being connectable to said connector aperture of said first housing part in a pressure-tight sealing connection, said pair of interchangeable connectors comprising a first connector configured for adapting the beverage dispensing system to a disposable tapping line, the first connector having a through-going hole for allowing guiding the disposable tapping line from within said inner chamber and through said through-going hole leading externally from said inner chamber, and a second connector configured for adapting the beverage dispensing system to a fixed tapping line, the second connector being connectable to the fixed tapping line leading externally from said inner chamber, and a pair of beverage containers, both having a body part for accommodating a beverage and a beverage outlet for allowing extraction of said beverage from said beverage container, both beverage containers having a closure for closing off said beverage outlet and for sealing against a sealing element of said inner chamber or one of said pair of interchangeable connectors for establishing an interspace between an outer wall of said body part and an inner wall of said inner chamber, a first beverage container of said pair of beverage containers comprising said disposable tapping line communicating with said beverage outlet via said closure and a second beverage container of said pair of beverage containers having an openable seal at said closure for establishing connection from said beverage outlet to said second connector, and, a pressure inlet for communicating with said interspace for allowing admission of a pressure medium thereto.

2. The beverage dispensing system according to claim 1, wherein said first housing part and said second housing part are separable for inserting and removing said beverage containers.

3. The beverage dispensing system according to claim 1, wherein said first housing part and said second housing part are permanently connected, one of said first and second housing parts comprises a lid for inserting and removing said beverage containers.

4. The beverage dispensing system according to claim 1, wherein said beverage dispensing system comprises a third housing part configurable as a replacement of said second housing part, having a different volume than said second housing part and being connectable to said first housing part for establishing said inner chamber.

5. The beverage dispensing system according to claim 1, wherein said inner chamber defines one or more of between 2 and 100 litres, between 5 and 50 litres, or between 10 and 25 litres.

6. The beverage dispensing system according to claim 1, wherein said beverage dispensing system further comprises a compressor and a gas cylinder selectively connectable to said pressure inlet for providing said pressure medium to said interspace.

7. The beverage dispensing system according to claim 1, wherein said beverage dispensing system further comprises a pass through cooler for cooling said disposable tapping line or said fixed tapping line, a cooling housing for accommodating or being integrated with said pressure housing, and an ice container for accommodating a solid cooling block.

8. The beverage dispensing system according to claim 1, wherein said pressure housing is thermally insulated.

9. The beverage dispensing system according to claim 1, wherein said beverage dispensing system further comprises a first electric power unit for being powered by a main supply and a second power unit including a battery supply.

10. The beverage dispensing system according to claim 1, wherein said second connector includes a three-way valve connected to said second beverage container and a cleaning unit including a cleaning fluid, said three-way valve defining a first position allowing extraction of said beverage from said second beverage container while preventing extraction of said cleaning fluid from said cleaning unit, and, a second position allowing extraction of said cleaning fluid from said cleaning unit while preventing extraction of said beverage from said beverage container.

11. The beverage dispensing system according to claim 1, wherein said beverage dispensing system comprises wheels, a bar counter and a tapping device connected to said disposable tapping line or fixed tapping line and positioned on said bar counter, or alternatively, wherein said beverage dispensing system comprises an integrated tapping device connected to said disposable tapping line or fixed tapping line.

12. The beverage dispensing system according to claim 1, wherein said beverage dispensing system comprises carrying straps for being carried around by a user, and a hand held tapping device connected to said disposable tapping line or fixed tapping line.

13. The beverage dispensing system according to claim 9, wherein the beverage dispensing system further comprises a third power unit including a solar power supply.

14. A method of operating a beverage dispensing system, said method comprising the steps of:

providing a pressure housing comprising a first housing part and a second housing part being connected to or being connectable to said first housing part for establishing an inner chamber when said first housing part and said second housing part are being connected together, said first housing part having a connector aperture, providing a pair of interchangeable connectors comprising a first connector configured for adapting the beverage dispensing system to a disposable tapping line and having a through-going hole, the pair of interchangeable connectors comprising a second connector configured for adapting the beverage dispensing system to a fixed tapping line leading externally from said inner chamber, providing a pair of beverage containers, both having a body part accommodating a beverage, a beverage outlet and a closure closing off said beverage outlet, a first beverage container of said pair of beverage containers comprising the disposable tapping line communicating with said beverage outlet via said closure and a second beverage container of said pair of beverage containers having an openable seal at said closure, and establishing a first operational mode by connecting said first connector to said connector aperture of said first housing part in a pressure-tight sealing connection, accommodating said first beverage container within said inner chamber, sealing said closure of said first beverage container against a sealing element of said inner chamber or said first connector for establishing an interspace communicating with a pressure inlet between the outer wall of said body part of said first beverage container and the inner wall of said inner chamber, guiding said disposable tapping line from within said inner chamber and through said through-going hole leading externally from said inner chamber, admitting a pressure medium into said interspace via said pressure inlet, and, extracting said beverage from said beverage container via said beverage outlet, or establishing a second operational mode by connecting said second connector to said connector aperture of said first housing part in a pressure-tight sealing connection, accommodating said second beverage container within said inner space, sealing said closure of said second beverage container against a sealing element of said inner chamber or said second connector for establishing an interspace between the outer wall of said body part of said second beverage container and the inner wall of said inner chamber, connecting said second connector to said openable seal and to the fixed tapping line leading externally from said inner chamber, admitting a pressure medium into said interspace via said pressure inlet, and, extracting said beverage from said beverage container via said beverage outlet.

15. A pressure housing comprising a first housing part and a second housing part being connected to or being connectable to said first housing part for establishing an inner chamber when said first housing part and said second housing part are being connected together, said first housing part having a connector aperture, said pressure housing comprising a pair of interchangeable connectors, both being connectable to said connector aperture of said first housing part in a pressure-tight sealing connection, said pair of interchangeable connectors comprising a first connector having a through-going hole for allowing guiding a disposable tapping line from within said inner chamber and through said through-going hole leading externally from said inner chamber, and a second connector being connected to or being connectable to a fixed tapping line leading externally from said inner chamber, said pressure housing being further compatible with a pair of beverage containers, both having a body part for accommodating a beverage and a beverage outlet for allowing extraction of said beverage from said beverage container, wherein said pressure housing or one of said pair of connectors comprises a sealing element for establishing an interspace between the outer wall of said body part and the inner wall of said inner chamber, said interspace communicating with a pressure inlet for allowing admission of a pressure medium to said interspace.

16. A kit for a beverage dispensing system, characterized in that the kit comprises:

a first connector and a second connector of a pair of interchangeable connectors both configured for being connectable to a same connector aperture of a first housing part of a pressure housing defining an inner chamber in a pressure-tight sealing connection, said first connector configured for adapting the beverage dispensing system to a disposable tapping line, the first connector having a through-going hole configured for allowing guiding the disposable tapping line from within the inner chamber and through said through-going hole leading externally from the inner chamber, and said second connector configured for adapting the beverage dispensing system to a fixed tapping line, wherein the second connector is configured for being connectable to the fixed tapping line leading externally from the inner chamber, and a pair of beverage containers, both having a body part for accommodating a beverage and a beverage outlet for allowing extraction of said beverage from said beverage container, both beverage containers having a closure for closing off said beverage outlet, wherein the closures are configured for sealing against a sealing element of the inner chamber or against one of said pair of connectors configured for establishing an interspace between the outer wall of said body part and an inner wall of the inner chamber, a first beverage container of said pair of beverage containers comprising said disposable tapping line communicating with said beverage outlet via said closure and a second beverage container of said pair of beverage containers having an openable seal at said closure configured for establishing connection from said beverage outlet to said second connector.

* * * * *